US007584772B2

(12) United States Patent
Jonkka

(10) Patent No.: US 7,584,772 B2
(45) Date of Patent: Sep. 8, 2009

(54) METHOD FOR CLAMPING A KNIFE IN A DISC CHIPPER AND A KNIFE CLAMP FOR A KNIFE ASSEMBLY

(75) Inventor: Arvo Jonkka, Pori (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/517,845

(22) PCT Filed: Jun. 18, 2003

(86) PCT No.: PCT/FI03/00495

§ 371 (c)(1),
(2), (4) Date: Dec. 15, 2004

(87) PCT Pub. No.: WO2004/002698

PCT Pub. Date: Jan. 8, 2004

(65) Prior Publication Data

US 2005/0211339 A1 Sep. 29, 2005

(30) Foreign Application Priority Data

Jun. 26, 2002 (FI) ..... 20021248

(51) Int. Cl.
*B27C 1/00* (2006.01)

(52) U.S. Cl. ..... 144/162.1; 144/174; 144/176; 144/218

(58) Field of Classification Search ..... 144/373, 144/176, 162.1, 230, 241, 174, 175, 218, 144/235; 241/92, 294, 298
See application file for complete search history.

(56) References Cited

U.S. PATENT DOCUMENTS 2,712,904 A * 7/1955 Durkee ..... 241/92
2,922,590 A * 1/1960 Bland ..... 241/92
3,000,578 A * 9/1961 Riches et al. ..... 241/92
3,542,302 A * 11/1970 Salzmann, Jr. ..... 241/298
3,572,594 A * 3/1971 Kershaw ..... 241/55
3,865,164 A * 2/1975 Sybertz ..... 144/230
3,981,337 A * 9/1976 Sundstrom ..... 144/241
4,047,670 A * 9/1977 Svensson ..... 241/92
4,155,384 A * 5/1979 Svensson ..... 241/92
4,194,545 A * 3/1980 Kostermeier ..... 144/230
4,271,882 A * 6/1981 Valo ..... 144/241
4,355,673 A * 10/1982 Kostermeier ..... 144/230
4,545,413 A 10/1985 Sundberg et al.

(Continued)

FOREIGN PATENT DOCUMENTS

DE 4232399 A1 * 3/1994

(Continued)

*Primary Examiner*—Bena Miller
(74) *Attorney, Agent, or Firm*—Buchanan Ingersoll & Rooney PC

(57) ABSTRACT

The invention concerns a method for clamping a knife of a disc chipper, wherein the knife is pressed from the knife disc via knife a clamp against a wear plate in a diagonal position (α) with respect to the plane of the knife disc with a compressive force (N) substantially parallel with the axis of the knife disc. According to the invention, the compensating force of the force directed to the knife clamp, caused by the diagonal position (α) of the knife and transversal to the compressive force (N) is exerted to the wear plate.

4 Claims, 5 Drawing Sheets

U.S. PATENT DOCUMENTS

| | | | | | |
|---|---|---|---|---|---|
| 4,694,995 | A | * | 9/1987 | Holmberg et al. | 241/92 |
| 4,754,789 | A | * | 7/1988 | Jonsson | 144/241 |
| 4,784,337 | A | * | 11/1988 | Nettles et al. | 241/92 |
| 4,887,772 | A | * | 12/1989 | Robinson et al. | 241/92 |
| 5,287,901 | A | * | 2/1994 | Matthews | 144/176 |
| 5,444,904 | A | | 8/1995 | Kokko | |
| 5,456,300 | A | * | 10/1995 | Rosenkranz et al. | 144/230 |
| 5,649,579 | A | * | 7/1997 | Kokko et al. | 144/176 |
| 5,660,218 | A | | 8/1997 | Jonkka | |
| 5,765,452 | A | * | 6/1998 | Roux et al. | 76/115 |
| 5,857,508 | A | * | 1/1999 | Jonkka | 144/363 |
| 5,904,193 | A | * | 5/1999 | Kellner | 144/230 |
| 5,996,655 | A | * | 12/1999 | Cramond et al. | 144/176 |
| 6,056,030 | A | * | 5/2000 | Jonkka | 144/176 |
| 7,134,462 | B2 | * | 11/2006 | Liu | 144/117.1 |

FOREIGN PATENT DOCUMENTS

| | | |
|---|---|---|
| EP | 0 468 458 | 1/1992 |
| GB | 525010 | 8/1940 |
| WO | WO 99/58310 | 11/1999 |

* cited by examiner

Prior Art Fig. 1

Prior Art Fig. 2

METHOD FOR CLAMPING A KNIFE IN A DISC CHIPPER AND A KNIFE CLAMP FOR A KNIFE ASSEMBLY

FIELD OF THE INVENTION

The present invention concerns a method for clamping a knife of a disc chipper against a wear plate by means of a knife press between the wear plate and the knife disc. The invention also concerns a knife clamp, that is pressed by a device supported from the knife disc and that is supported to the knife and the wear plate.

BACKGROUND OF THE INVENTION

Disc chippers are generally used in the wood processing industry for chipping wood prior to the further processing. The rotating disc of a chipper is equipped with knives attached evenly distributed thereto cutting chips from a log against a counter knife. The knives are generally attached to the disc through separate knife presses that are locked in position generally by means of a compressive force provided by bolts. The knife press by means of which the knife is pressed in its position is in this publication referred to as knife clamp.

When attaching a knife in its position in the knife disc according to a method of prior art, the knife clamp and the knife are pressed with bolts against the wear plate. The method is described e.g. in the publication U.S. Pat. No. 6,056,030. The bolts are parallel with the axis of the knife disc. The bolts have their support from the knife disc and move the knife clamp and the knife in the axial direction of the knife disc, away from the knife disc towards the inclined surface of the wear plate, against which the knife is positioned. This positioning surface of the knife in the wear plate deviates due to its inclination from the direction perpendicular to the pressing motion of the clamp, whereby the knife clamp and the knife are subject to forces from the wear plate, that tend to move the knife clamp aside from the direction of the desired pressing motion. Against this transversal motion the knife clamp is supported from the knife disc near the compressing bolt. A friction force is generated to the point of support resisting the movement of the knife clamp during the compressing process.

SUMMARY OF THE INVENTION

The method in accordance with the present invention is characterized in, that the point of support preventing the transversal movement of the knife clamp is positioned in the wear plate on the area of the plane between the knife and the knife clamp, said area facing the knife, whereby the transversal force required for attaching the knife increases the compressive force between the knife clamp and the knife. The knife clamp in accordance with the invention substantially takes the support of the knife clamp against the transversal movement from the wear plate by means of a bracket of the knife clamp. Due to the method, the compressive force of the knife clamp can be provided also with other methods than bolt attachment, because a supporting surface of the knife disc under the knife clamp is not essential.

BRIEF DESCRIPTION OF THE DRAWINGS

The invention and its details will now be described in more detail with reference to the enclosed drawings, where.

DESCRIPTION OF THE PREFERRED EMBODIMENT

Figure 1:
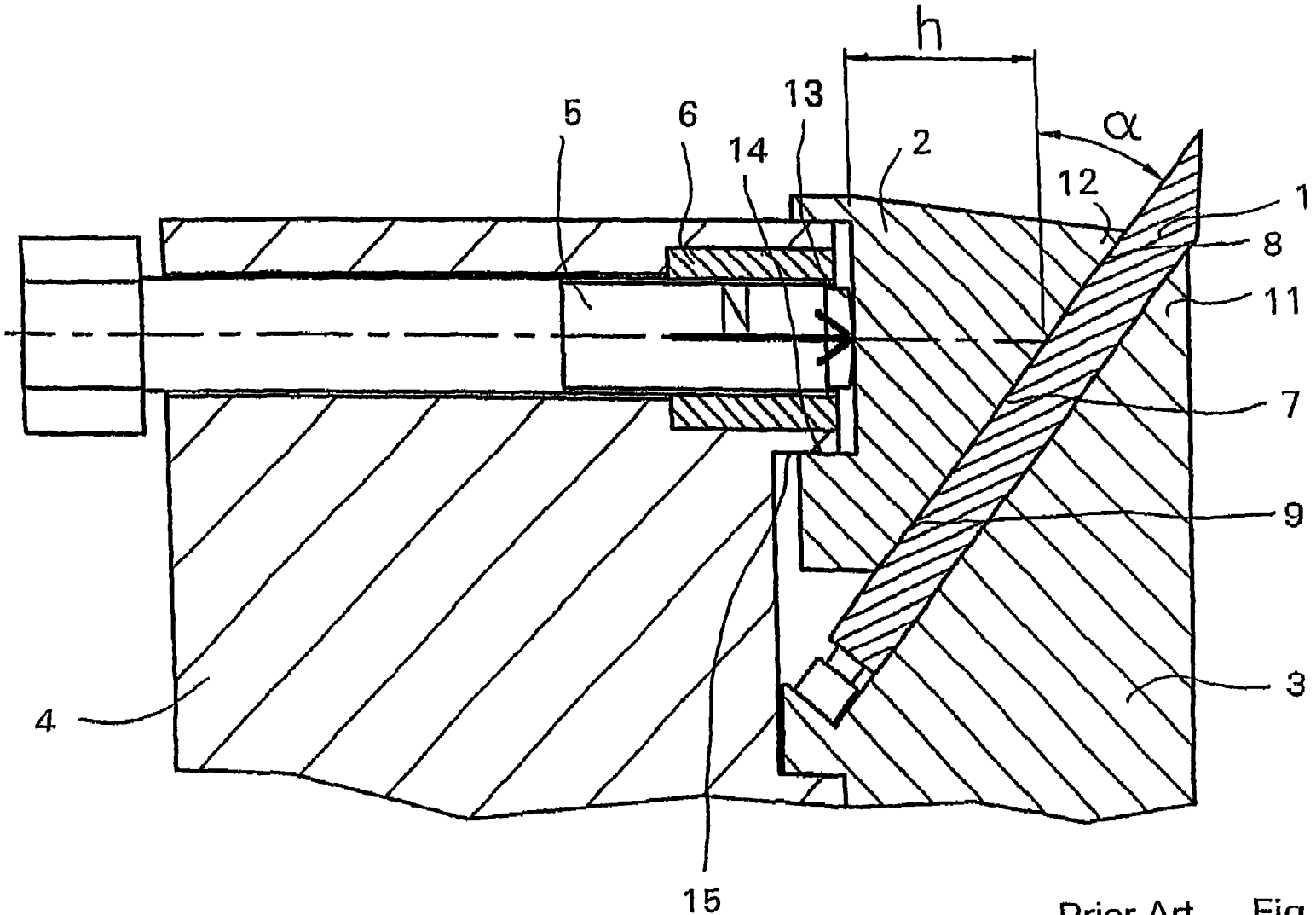
FIG. 1 shows a traditional knife assembly and knife clamp of a disc chipper.

FIG. 1 shows a generally used knife assembly. Knife 1 is attached in its place by pressing the knife by means of a knife clamp 2 against a wear plate 3. Bolts for attaching the wear plate to the knife disc 4 is not shown in the figure. The knife clamp 2 is pressed in the direction of arrow N against the knife 1 by means of a bolt 5. Bolt 5 is supported from the knife disc 4 by means of a hardened threaded bushing 6. The surface 7 of the knife clamp placed against the knife 1 is formed slightly concave, so that the knife clamp is supported against the knife at points 8 and 9. Thus, the knife 1 has the best possible support from the knife clamp 2 despite of small inaccuracies in manufacturing. The most important thing is to the have the knife supported in the best possible way near the point of the knife by means of surface 8.

It has been noticed in the practice that the point portion 11 of the wear plate 3 slightly yields due to the force N. Thus, also the knife 1 and the knife clamp 2 must turn from 0.2 to 0.3 mm at the point portion 12 thereof. Turning of the knife clamp and tensioning of the bolts 5 are contributed by the rounded ends 13 of the bolts.

Against the direction perpendicular to the pressing motion, the knife clamp is supported by means of the surface 14. The surface 14 is supported against the counter surface 15 in the knife disc and a friction force caused by the supporting force is generated between these surfaces.

During the chipping process the point 11 of the wear plate is in a small continuous bending motion and the size of said friction force varies continuously. In practice this variation causes a pulsating effect to the compressive force of the point 8 of the knife clamp. Function of the knife clamp is to keep the knives firmly attached to the chipper and another main function is to maintain an adequate compressive force on the area of the point 8. Decreasing of said compressive force is substantially influenced not only by the bending of the wear plate but also the force turning the knife clamp caused by the compressive force between the surfaces 14 and 15, said force being dependent on the height h and the angle $\alpha$ of the clamp, as shown in FIG 1. The height of the clamp is dependent on the adequate stiffness of the clamp and the distance between the screws 5. Angle $\alpha$ of the knife is in general about 36-40 degrees and it is influenced by the sharpening angle of the point of the knife.

Figure 2:
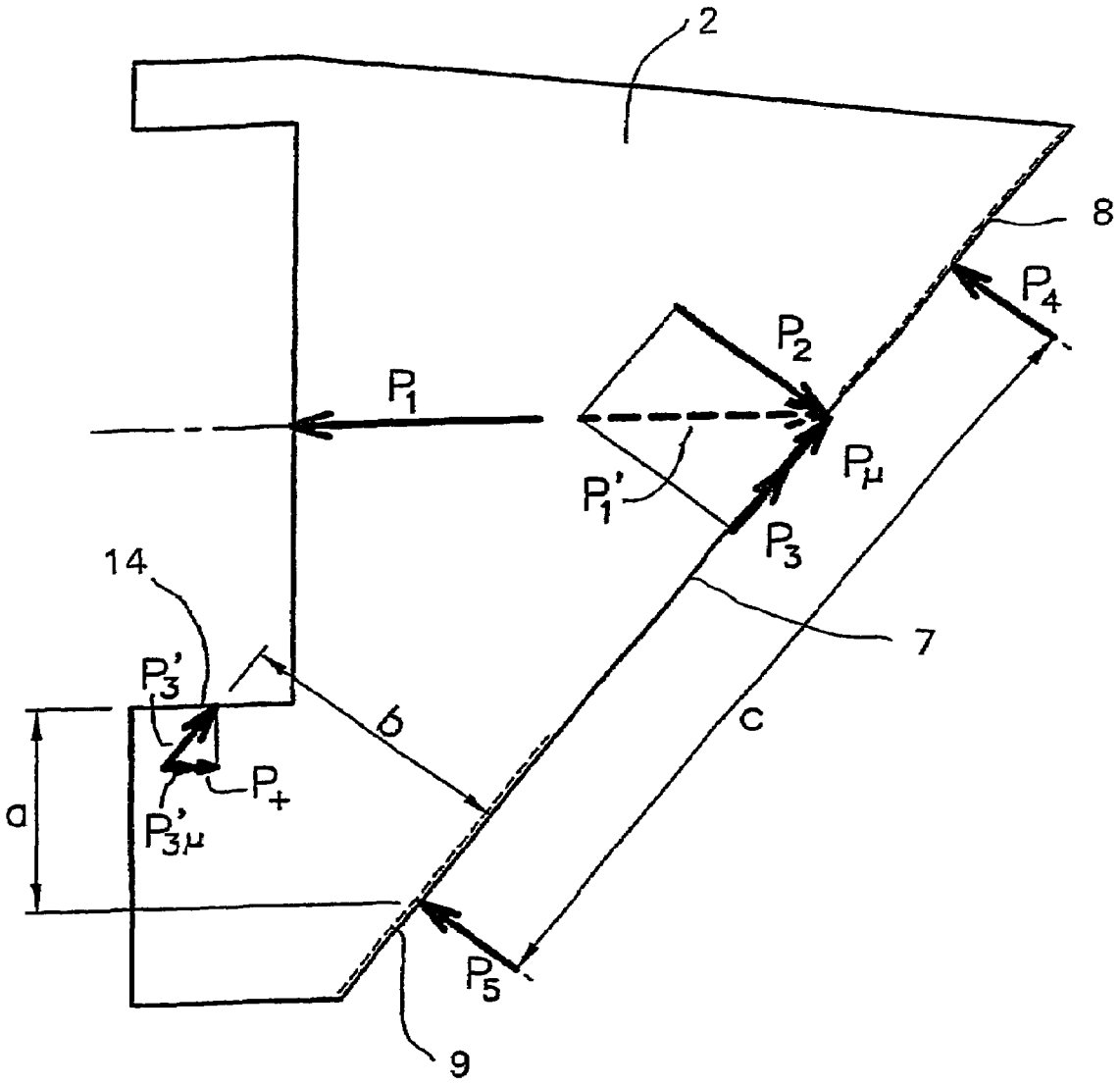
FIG. 2 shows the forces directed to the knife clamp.

Referring to FIG. 2, the arrows describe forces exerted by the knife clamp 2 to the other parts of the knife disc. For simplicity of the force figure, the concavity of the surface 7 of the knife clamp against the knife is not taken into account. The compressive force caused by the bolt is $P_1$ (=N). The correspondingly big supporting force $P_1'$ exerted to the knife 1 is divided into component $P_2$ effecting against the knife and component $P_3+P_\mu$ effecting in the direction of the knife. Force $P_3$ parallel with the surface of the knife, which is a residual force taking into account the friction force caused by $P_2$, tends to move the knife clamp from its place. The size of the force is dependent on the friction between the knife and the knife clamp. The surface of the knife clamp facing against the knife of the knife clamp is effected by the force $P_3$ coming from the knife, and force $P_3'$ affecting the knife disc is formed to the supporting surface 14. Forces $P_{3\mu}'$ and $P_+$ parallel with the surface 14 are formed thereby.

Force $P_2$ effects in perpendicular direction to the surface of the knife and it is divided into counter forces $P_4$ and $P_5$, which are located on their respective areas of influence 8 and 9. Most important is that the force $P_4$ maintains adequate. Distance of the above mentioned pair of forces is c and the size of this distance varies to some extent according to inaccuracies of the surfaces of the knife 1 and the knife clamp 2. Force $P_3$ moving aside the knife clamp from the direction of effect of force $P_1$ gives a decreasing effect ($P_4$) and an increasing effect ($P_5$) according to formula (b/c) $P_3$ to the pare of forces $P_4$-$P_5$. This results in additional need of force $P_1$, when a certain level of force $P_4$ is needed.

A bigger height h (FIG. 1) also increases the dimension b and requires increasing of the clamping force $P_1$. Harmful effect of this problem increases during the operation of the chipper, whereby the vibration decreases the influence of the friction and the compressive force of the area 8 can decrease as much as 50%. A minor effect increasing the force $P_1$ comes from force $P_+$ according to formula (a/c) $P_+$. This increasing portion of the main force $P_1$ ranges from 3 to 10%. When the knife 1 gets narrower due wearing, the dimension a is 0 and there is no favourable effect $P_+$.

Figure 3:
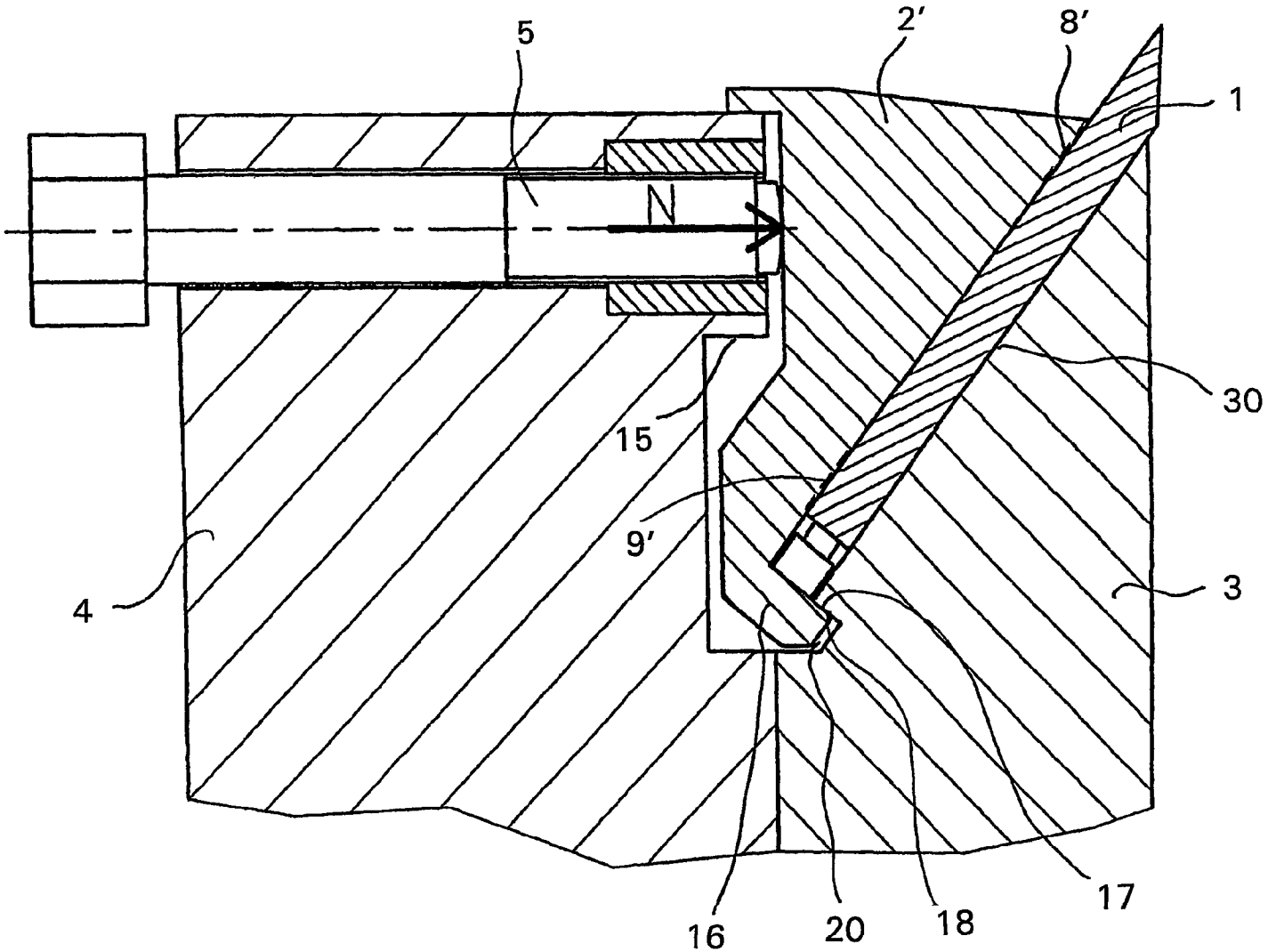
FIG. 3 shows a knife clamp according to the present invention.

A knife clamp 2' according to the invention is shown in FIG. 3. The knife clamp 2' is supported against the perpendicular direction parallel with the compressive motion N by means of the surface 17 of the bracket 16. Otherwise the knife clamp 2' corresponds to that shown in FIG. 1. Counter surface for the bracket 16 is the surface 18 of the groove 20 in the wear plate 3. The system according to the present invention has that considerable benefit that no supporting surface 15 is needed and the knife clamp according to FIG. 3 can also be used with other attaching methods than bolts.

Figure 4:
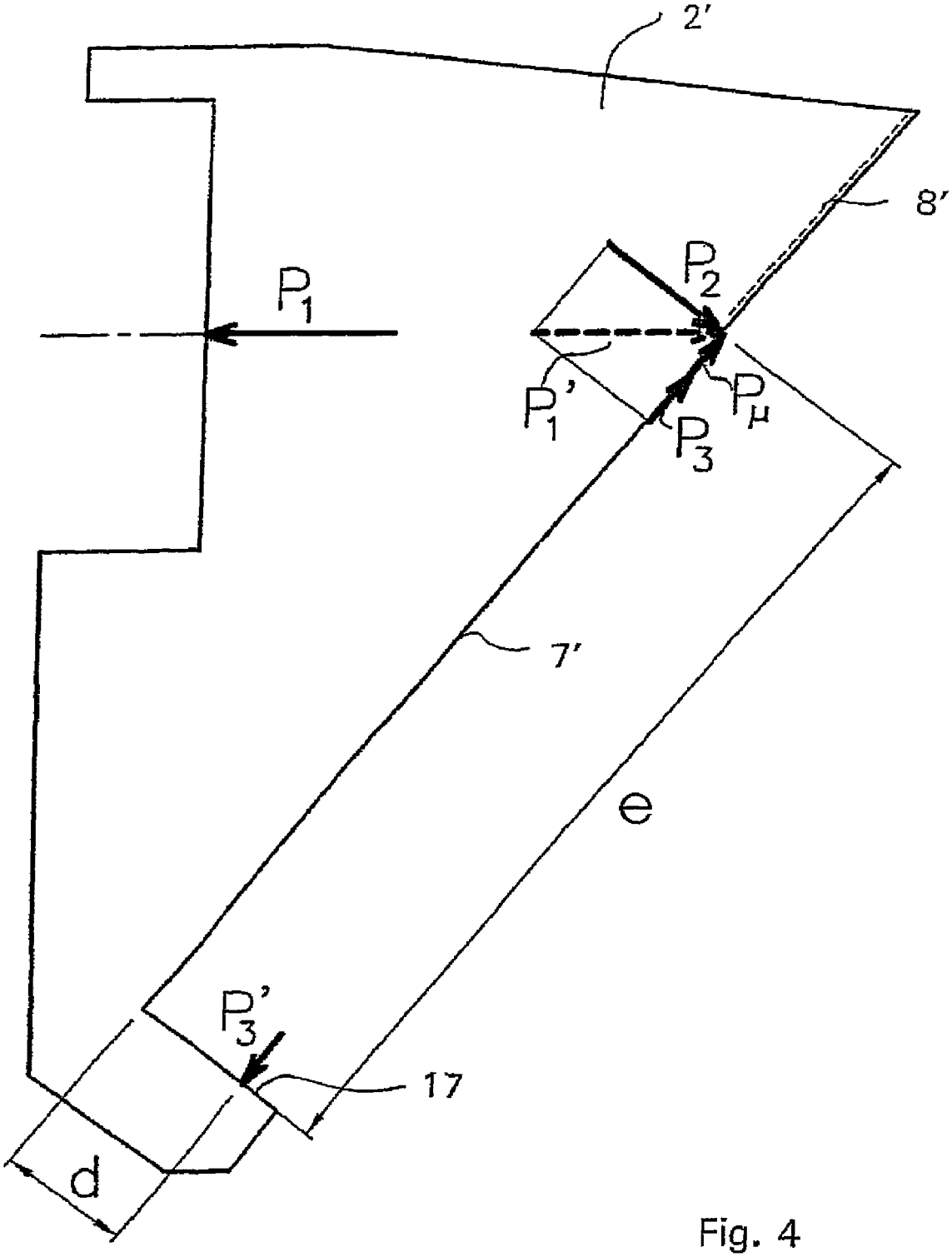
FIG. 4 shows forces directed to the knife clamp according to the present invention.

In the knife clamping system of FIG. 3 according to the present invention, the support of the transversal force effected by the clamping force N of the knife clamp has been moved over to the other side of the surface 30 between the knife 1 and the knife clamp 2' compared with the system shown in FIG. 1. The force pattern of the construction of FIG. 3 shown in FIG. 4 shows that correspondingly force $P_3$ parallel with the surface of the knife as well as a corresponding supporting force $P_3'$ are generated in this construction to the surface 17. The force increasing the force $P_2$ against the knife can be calculated from the FIG. 4 by formula (d/e) $P_3'$. As it is evident from said formula, that a long surface 7' against the knife is unfavourable with respect to the increasing of force $P_2$. A wide knife 1 according to FIG. 3, however, requires a wide knife clamp 2'.

Figure 5:
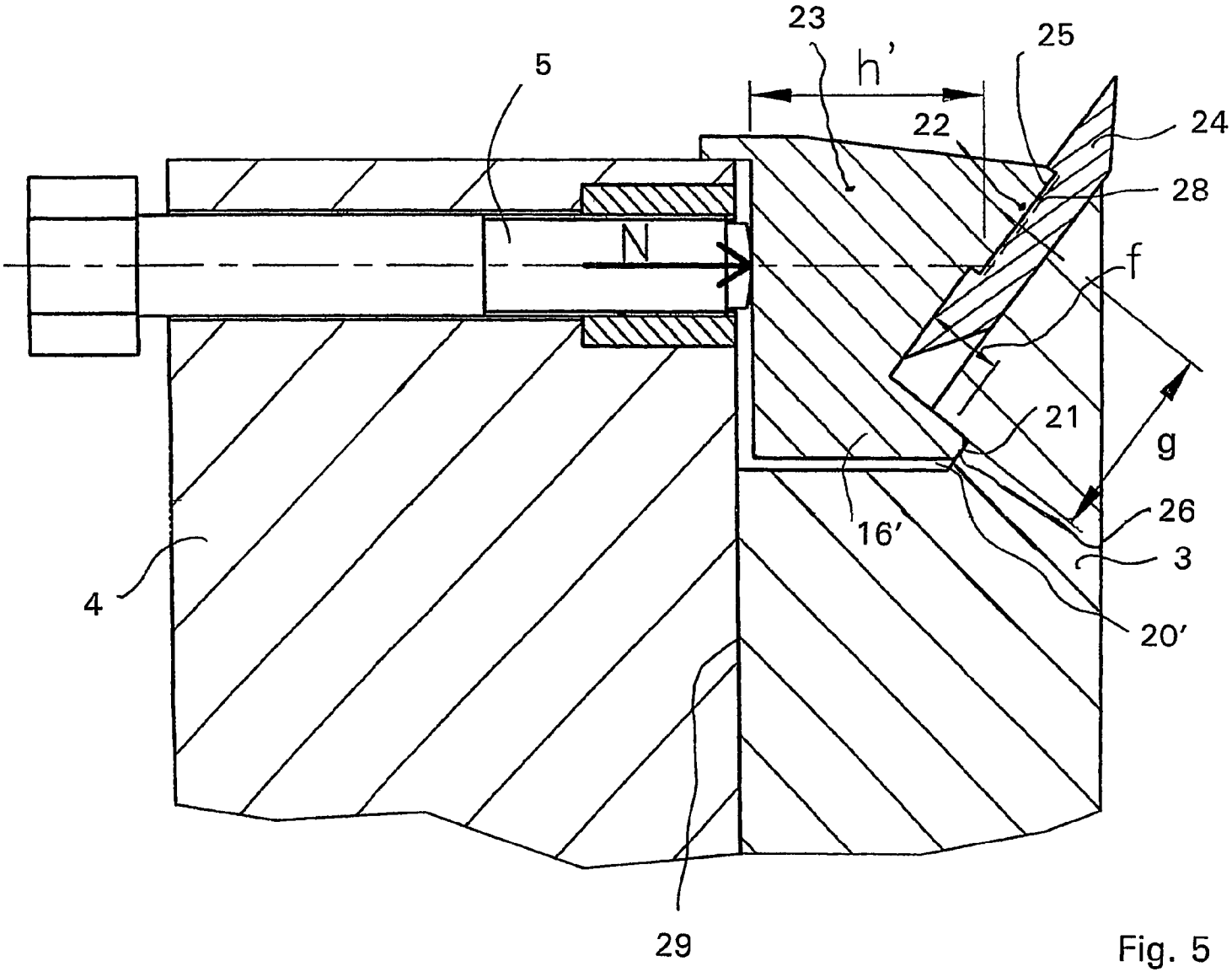
FIG. 5 shows a preferred construction according to the present invention.

The advantages of the present invention become evident from the construction in accordance with FIG. 5, where the knife 24 is led in position through the groove 25 by means of a projection 22 of the knife clamp 23. Turn knife 24 equipped with two points is much narrower than the knife of FIGS. 1 and 3 and requires thereby a better support. Thereby the supporting of the knife 24 is a much more demanding task and the knife clamp according to the invention and FIG. 5, where the relation of dimensions f/g is bigger than the relation d/e according to FIG. 3 is a suitable solution for this purpose. An adequate strength is also reached without any problems, because height h' does not matter.

A wide knife as shown in FIG. 3 requires two supporting regions 8' and 9' between the knife clamp and the knife. There the bracket 16 cannot be used for supporting the force $P_2$, because a three-point or three-area supporting is not successful due to fabrication inaccuracies. The knife clamp according to FIG. 5, instead, forms only one supporting area 28 against the knife from the bottom of the groove 25. Another balancing support is provided by the bottom surface 26 of the groove 20', against which the corresponding surface 21 of the bracket 16' is supported, whereby bracket 16' receives the force $P_3'$ and a part of the force $P_2$. Thereby an adequate clamping of the knife can be achieved with a reasonable force N.

The arrangement in accordance with FIG. 5 has an additional advantage therein that the knife disc 4 has a surface 29 with no groove. This means considerable savings in costs of machining.

Oversized compressive forces require a large number of clamping screws and big forces result in durability problems of threads and bending of the wear plate 3 as well as in permanent deformation, which causes functional disturbances and need of changing components. By means of a method and a knife clamp in accordance with the present invention, the disadvantages mentioned above can be avoided.

The invention claimed is:

1. A chipper apparatus comprising:

a disc rotatable about a rotation axis and including a knife side, wherein the axis passes through the knife side;

a wear plate fastened on the knife side;

a clamp disposed on the knife side axially between the disc and the wear plate and being movable relative to the disc;

a knife disposed between the clamp and the wear plate and extending in a projecting direction;

a compressing element arranged for exerting a clamping force on the clamp in a direction substantially parallel to the rotation axis and away from the disc to cause the clamp to urge the knife away from the disc and against the wear plate;

the wear plate including a groove having a first surface, and the clamp including a bracket portion extending into the groove, wherein the bracket portion bears against the first surface when the clamping force is applied to the clamp; and the clamp including a second surface extending transversely of the projecting direction of the knife and against which a portion of the knife is supported.

2. The chipper apparatus according to claim 1 wherein the bracket portion bears against the groove's first surface by means of the clamp's second surface.

3. The chipper apparatus according to claim 1 wherein the clamp includes a projection received in a notch of the knife, the notch arranged between a tip end of the knife and an inner end of the knife, the projection arranged to transmit the clamping force to the knife.

4. The chipper apparatus according to claim 3 wherein the clamp's second surface is formed by the projection.

* * * * *